US005255484A

United States Patent [19]

Karlsohn

[11] Patent Number: 5,255,484

[45] Date of Patent: Oct. 26, 1993

[54] METHOD FOR FASTENING OF ELASTOMERIC OR INSULATING MATERIALS BETWEEN TWO STRUCTURAL COMPONENTS

[75] Inventor: Dieter Karlsohn, Erftstadt, Fed. Rep. of Germany

[73] Assignee: Clouth Gummiwerke AG, Cologne, Fed. Rep. of Germany

[21] Appl. No.: 681,504

[22] PCT Filed: Aug. 9, 1989

[86] PCT No.: PCT/EP89/00937

§ 371 Date: Oct. 10, 1991

§ 102(e) Date: Oct. 10, 1991

[87] PCT Pub. No.: WO90/04687

PCT Pub. Date: May 3, 1990

[30] Foreign Application Priority Data

Oct. 29, 1988 [DE] Fed. Rep. of Germany ..... 3836883

[51] Int. Cl.[5] ..... E04B 1/74

[52] U.S. Cl. ..... 52/404; 52/512

[58] Field of Search ..... 52/404, 506, 410, 512, 52/513

[56] References Cited

U.S. PATENT DOCUMENTS 4,184,307 1/1980 Anderson et al. ..... 52/513 X

*Primary Examiner*—Carl D. Friedman
*Assistant Examiner*—Creighton Smith
*Attorney, Agent, or Firm*—Herbert Dubno

[57] ABSTRACT

In a method for fastening of elastomeric or insulating materials, for instance an elastic mat, provided between two structural components whereby one of the structural components is produced on site after the elastomeric or insulating material has been inserted, the upper shank of a Z-shaped elastomer section consisting of two vertical shanks and a horizontal web is fastened by nails or the like to an already finished structural component, while the lower shank of the elastomer section reaches over the elastomeric or insulating material and then a cover element is fitted over the head of each nail or the like and after that an elastic cord is fitted onto the elastomer section. Finally, the second structural component is produced, whereby the elastomeric or insulating materials, the elastomer section, the cover element and the elastic cord serve as a disposable form.

5 Claims, 5 Drawing Sheets

METHOD FOR FASTENING OF ELASTOMERIC OR INSULATING MATERIALS BETWEEN TWO STRUCTURAL COMPONENTS

FIELD OF THE INVENTION

The invention relates to a method for fastening of elastomeric or insulating materials, for instance an elastic mat, between two structural components whereby one of the structural components is produced on site after the insertion of the elastomeric or insulating materials.

THE RELATED ART

In order to fasten elastomeric or insulating materials between two structural components, up to now sections of rigid synthetic material or metal have been used. However, these materials create sound conductors between the two structural components.

It is the object of the invention to create a fastening system which insures a secure fastening of the elastomeric or insulating material and at the same time has a decoupling effect on vibrations which may occur.

SUMMARY OF THE INVENTION

The solution to the problem consist in a method of the above-mentioned kind, whereby the upper shank of a Z-shaped elastomer section formed by two vertical shanks and one horizontal web is fastened by nails or the like to the already finished structural component, while the lower shank of the elastomer section reaches over the elastomeric or insulating materials and whereby then a cover element is fitted over the head of each nail or the like and after that an elastic cord is fitted on top of the elastomer section. Finally the second structural component is produced, whereby the elastomeric or insulating material, the elastomer section, the cover element and the elastic cord serve as a disposable form. The cover element prevents contact between the still fluid concrete and the nails or the like during the production of the second structural component, since at this contact points sound conductors can form.

By the method of the invention the transmission of vibrations from one structural component to another is completely eliminated. Furthermore, an elastic sealing of the gap between the two structural components results, so that horizontal as well as vertical motions of the two components can be elastically taken up.

In an embodiment of the invention the cover element is designed like a cap surrounding the washer provided under the head of each nail or the like.

In a further embodiment of the invention the used elastomer section has at its upper shank a horizontal flange,which together with the horizontal web forms a chamber for receiving the cover element, whereby the cover element is U-shaped and arranged in such a manner that in the mounted state the webs of the U-section face the elastomer section.

According to a further feature of the invention, the horizontal flange as well as the horizontal web are each provided with a ridge reaching behind the cover element.

In a particularly simple embodiment of the method of the invention the used elastomer section has at its upper shank a horizontal flange whereupon a cover element is formed.

Suitably, on the upper shank of the elastomer section an elastic cord is formed.

BRIEF DESCRIPTION OF THE DRAWING

The invention and its features may better be understood with reference to the drawing wherein.

DETAILED DESCRIPTION

Figure 1:
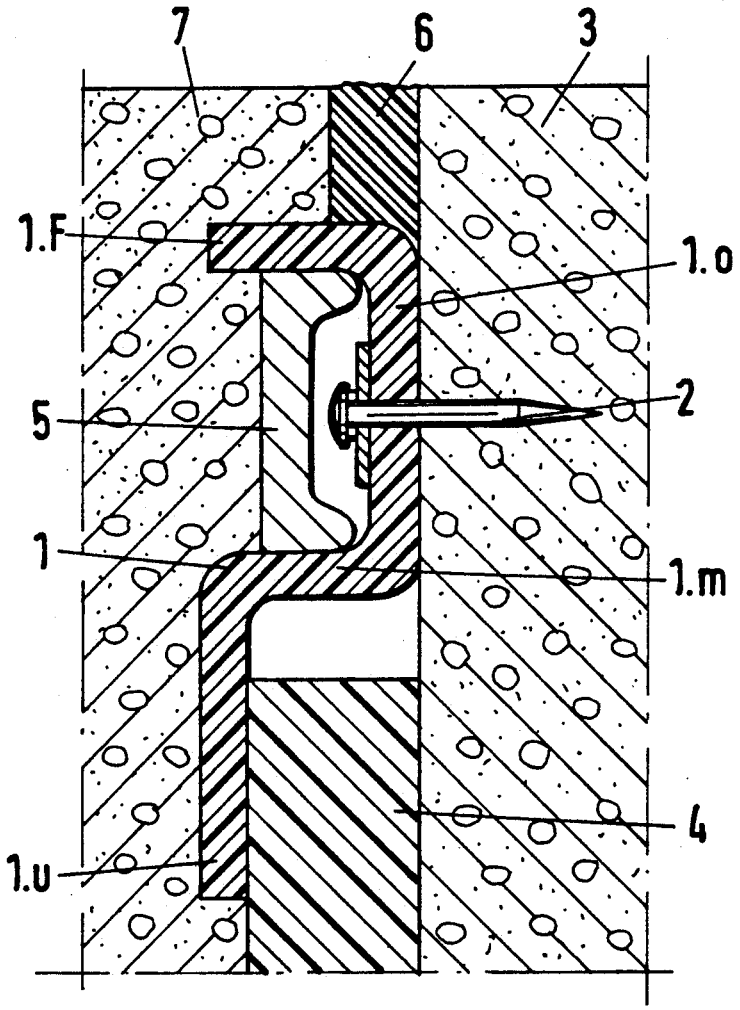
FIG. 1 illustrates in cross section a fastening system produced by the method of the invention.

In the embodiment example shown in FIG. 1 the upper vertical shank 1.o of a Z-shaped elastomer section 1 consisting of two vertical shanks 1.o and 1.u and horizontal web 1.m is fastened by nails 2 or the like to the finished structural component 3, while the lower shank 1.u of the elastomer section 1 reaches over an elastic mat 4. The elastomer profile 1 has on its upper shank 1.O a horizontal flange 1.F, which together with the horizontal web 1.m of the elastomer section 1 forms a chamber for receiving the cover element 5. On the upper shank 1.o of the elastomer section 1, respectively on the flange 1.F, an elastic cord 6 is fitted, which extends up to the surface of the structural component 3. The second structural component 7 is produced on site by using the elastic mat 4 , the elastomer section 1, the cover element 5 and the elastic cord 6 as a disposable form.

Figure 2:
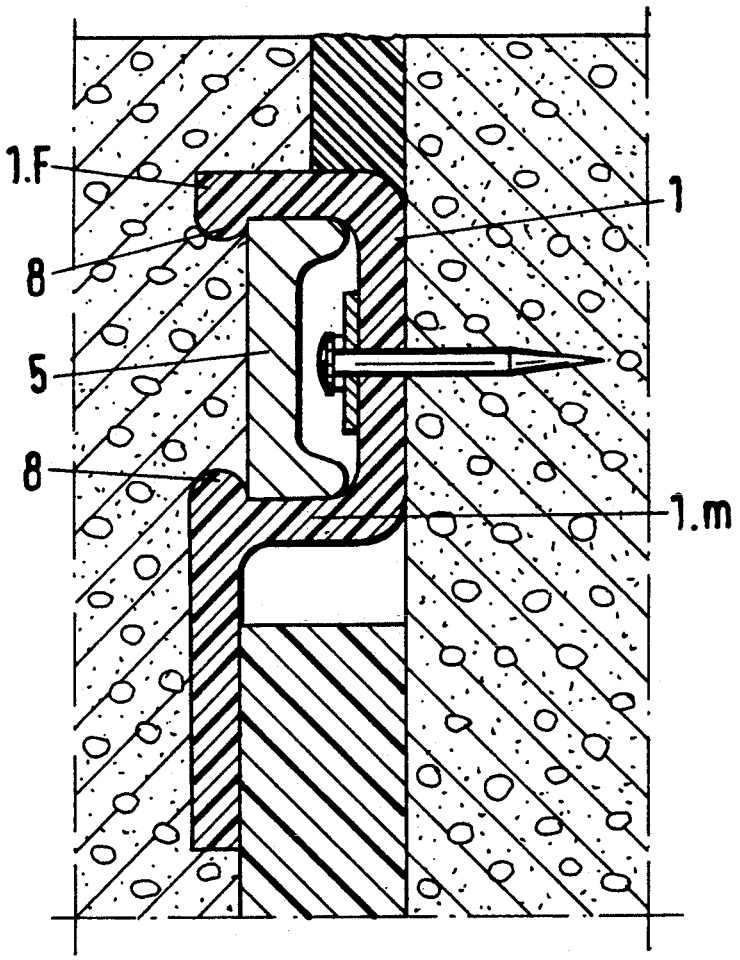
FIG. 2 illustrates in cross section a second embodiment of a fastening system produced by the method of the invention.

In FIG. 2 an embodiment example basically corresponding to FIG. 1, wherein the flange 1.F and the horizontal web 1.m of the elastomer section 1 each have a ridge 8 which reaches behind the cover element 5.

Figure 3:
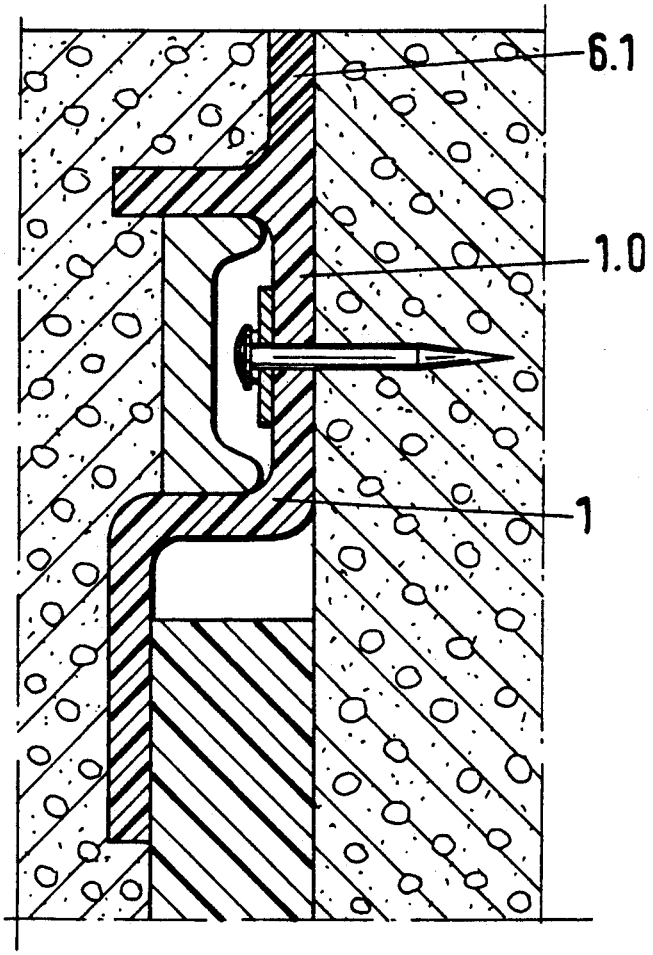
FIG. 3 illustrates in cross section a third embodiment of a fastening system produced by the method of the invention.

In the embodiment example shown in FIG. 3 on the upper shank 1.o of the elastomer section 1 an elastic cord 6.1 is formed.

Figure 4:
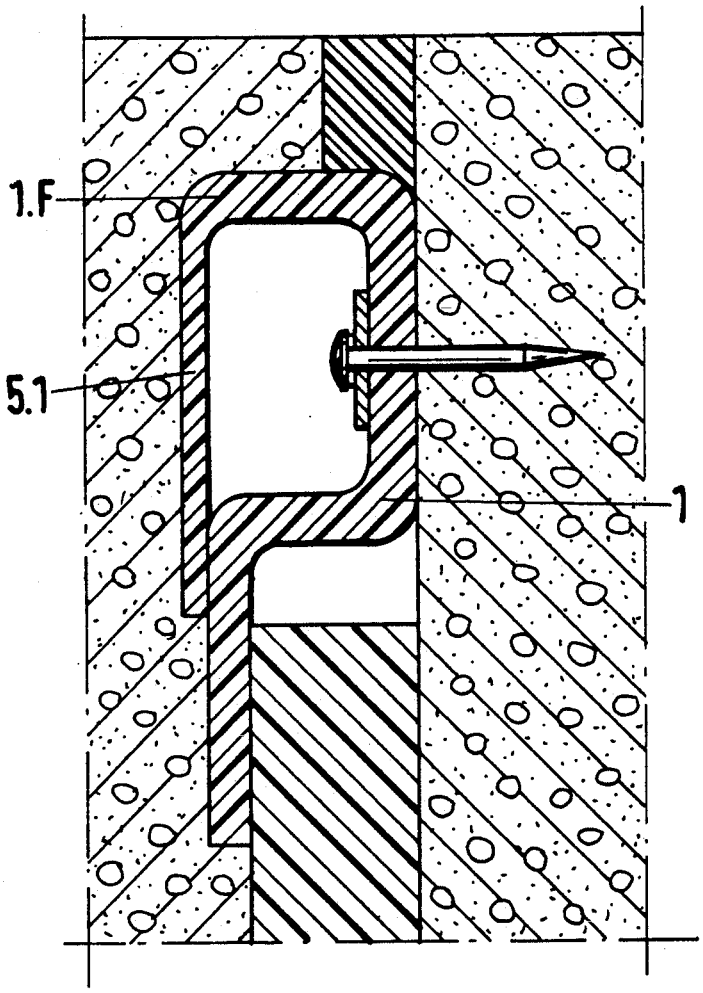
FIG. 4 illustrates in cross section a fourth embodiment of a fastening system produced by the method of the invention.

FIG. 4 shows an embodiment example wherein on the flange 1.F of the elastomer section 1 a cover element 5.1 is formed.

Figure 5:
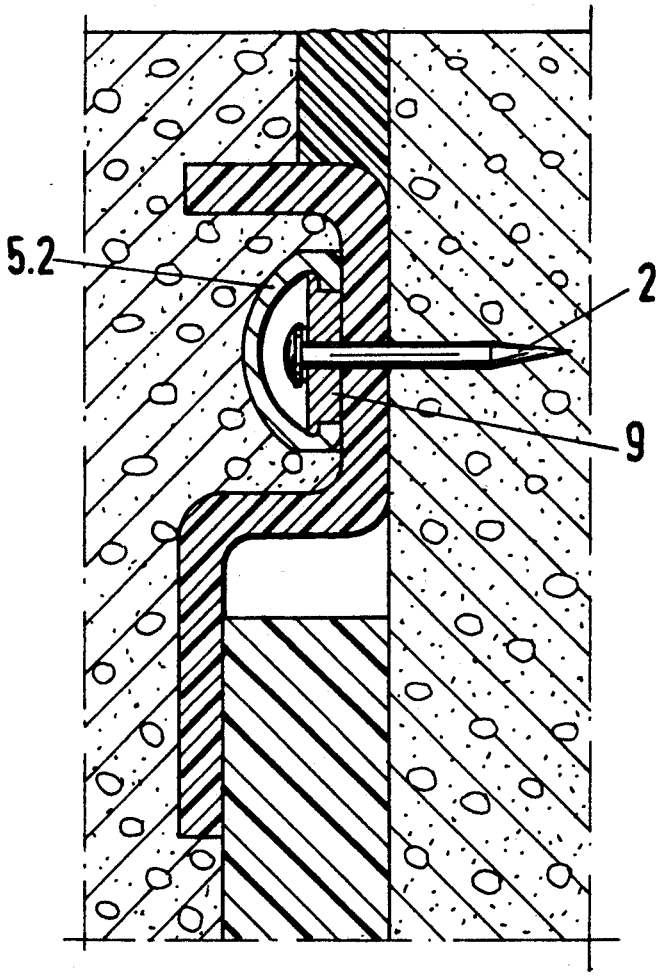
FIG. 5 illustrates in cross section a fifth embodiment of a fastening system produced by the method of the invention.

The embodiment example represented in FIG. 5 shows a fastening system wherein the cover element 5.2 is designed like a cap surrounding the washer 9 provided under each nail 2.

I claim:

1. A method for fastening an elastomeric or insulating mat between two structural components comprising:

applying said elastomeric or insulating mat to a surface of a first of said structural components;

attaching a Z-shaped elastomer section onto said surface of said first structural component, said Z-shaped elastomer section comprising an upper and a lower vertical shank offset but parallel to one another, a horizontal web joining respective ends of said upper and lower vertical shanks and being oriented perpendicular to said shanks, and a horizontal flange orthogonally formed on said upper vertical shank and being parallel to said horizontal web, thereby defining a chamber, and wherein said lower vertical shank extends over said mat;

securing said attached Z-shaped elastomer section by fastening same onto said surface with at least one nail driven through said upper vertical shank, said nail terminating in a head;

fitting a U-shaped cover element over said head of said at least one nail and mounted so that an open mouth of said U-shaped cover element faces said first of said structural elements and said head;

covering a combination of said mat, said Z-shaped elastomer section and said first structural component with a second of said structural components; and positioning an elastic cord adjacent said horizontal flange along said surface of said first structural component, said positioning occurring at any time prior to said covering step.

2. A method according to claim 1, further comprising a washer placed between said head and said first of said structural components, said cover element being a cap with arms surrounding sides of said washer.

3. A method according to claim 1, further comprising a ridge on an end of each of said horizontal web and said horizontal flange, said ridges facing towards one another and being of sufficient extension to retain said cover element in said chamber.

4. A method according to claim 1, further comprising a support element formed on one end of said horizontal flange or orthogonally thereto and extending sufficiently long to cover said chamber.

5. A method according to claim 1, wherein said elastic core is constructed unitary with said Z-shaped elastomer section.

* * * * *